US010405720B2

(12) United States Patent
Park et al.

(10) Patent No.: US 10,405,720 B2
(45) Date of Patent: Sep. 10, 2019

(54) VACUUM CLEANER AND GRAVITY COMPENSATION APPARATUS THEREFOR

(71) Applicant: Samsung Electronics Co., Ltd., Suwon-si (KR)

(72) Inventors: Heum Yong Park, Suwon-si (KR); Sung Jin Park, Suwon-si (KR); Dong Hun Lee, Ansan-si (KR); Shin Kim, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 353 days.

(21) Appl. No.: 15/302,416

(22) PCT Filed: Mar. 27, 2015

(86) PCT No.: PCT/KR2015/003050
§ 371 (c)(1),
(2) Date: Oct. 6, 2016

(87) PCT Pub. No.: WO2015/156523
PCT Pub. Date: Oct. 15, 2015

(65) Prior Publication Data

US 2017/0020353 A1 Jan. 26, 2017

(30) Foreign Application Priority Data

Apr. 9, 2014 (KR) ..... 10-2014-0042483

(51) Int. Cl.
*A47L 9/32* (2006.01)
*A47L 5/28* (2006.01)
*A47L 5/30* (2006.01)

(52) U.S. Cl.
CPC ..... *A47L 9/325* (2013.01); *A47L 5/28* (2013.01); *A47L 5/30* (2013.01)

(58) Field of Classification Search
CPC ... A47L 9/325; A47L 5/30; A47L 5/28; A47L 9/32
See application file for complete search history.

(56) References Cited

U.S. PATENT DOCUMENTS 2,226,362 A 12/1940 White
2,243,066 A 5/1941 Becker
(Continued)

FOREIGN PATENT DOCUMENTS

CN 1169487 10/2004
CN 1611173 5/2005
(Continued)

OTHER PUBLICATIONS

Extended European Search Report dated Nov. 17, 2017 in European Patent Application No. 15776778.1.
(Continued)

*Primary Examiner* — David Redding
(74) *Attorney, Agent, or Firm* — Staas & Halsey LLP

(57) ABSTRACT

In accordance with one aspect of the present invention, a cleaner includes a gravity compensation apparatus for applying compensation force to a handle unit, the gravity compensation apparatus having an elastic member connected to one side of the handle unit to generate compensation force and a sliding member for making translational movement in conjunction with turning motion of the handle unit to keep the compensation force in a constant direction regardless of an angle of the handle unit. The torque due to gravity applied to a handle unit of a vacuum cleaner may be precisely compensated, thereby relieving the burden of the user from the weight of the handle unit while the user holds the handle unit for cleaning.

20 Claims, 13 Drawing Sheets

(56) References Cited

U.S. PATENT DOCUMENTS

| | | | | |
|---|---|---|---|---|
| 2,333,460 | A | 11/1943 | Berg | |
| 6,647,586 | B2 | 11/2003 | Rogers et al. | |
| 7,310,855 | B2 | 12/2007 | Blocker et al. | |
| 7,950,102 | B2 * | 5/2011 | Lee | A47L 9/325 15/327.4 |
| 2001/0047563 | A1 | 12/2001 | Kim | |
| 2002/0104184 | A1 | 8/2002 | Rogers et al. | |
| 2006/0005348 | A1 | 1/2006 | Blocker et al. | |

FOREIGN PATENT DOCUMENTS

| | | |
|---|---|---|
| CN | 104188595 | 12/2014 |
| JP | 6-90878 | 4/1994 |
| KR | 10-2012-0004103 | 1/2012 |
| KR | 10-2012-0014326 | 2/2012 |

OTHER PUBLICATIONS

Australian Notice of Acceptance dated Nov. 16, 2017 in Australian Patent Application No. 2015244672.
Office Action issued in corresponding Australian Patent Application No. 2015244672 dated Aug. 9, 2017.
Chinese Office Action dated Jun. 28, 2018 in Chinese Patent Application No. 201580029211.0.
International Search Report dated Jun. 29, 2015 in corresponding International Application No. PCT/KR2015/003050.
Chinese Notice of Allowance dated Mar. 5, 2019 in Chinese Patent Application No. 201580029211.0.

* cited by examiner

VACUUM CLEANER AND GRAVITY COMPENSATION APPARATUS THEREFOR

CROSS REFERENCE TO THE RELATED APPLICATION

This application is a U.S. national stage application, which claims the benefit under 35 USC § 371 of PCT International Patent Application No. PCT/KR2015/003050, filed Mar. 27, 2015 which claims foreign priority benefit under 35 USC § 119 of Korean patent application No. 10-2014-0042483, filed Apr. 9, 2014, the contents of which are herein incorporated by reference.

TECHNICAL FIELD

The present disclosure relates to a vacuum cleaner and gravity compensation apparatus included in the vacuum cleaner.

BACKGROUND ART

Vacuum cleaner is a consumer appliance for performing cleaning with a fan motor for generating suction power, a suction nozzle for sucking in air of a surface to be cleaned, and a dust collector for separating and collecting dirt from the air sucked in.

The vacuum cleaner may be divided by shape into a canister type, upright type, handy type, robot cleaner type, etc.

In the common upright type vacuum cleaner, a wheel is equipped for the suction unit having the suction nozzle, and a handle unit having the fan motor, the dust collector, and a handle is rotationally combined with the suction unit. Accordingly, the suction unit remains upright in ordinary times, but during cleaning, the user performs cleaning by tilting the handle unit.

While tilting the handle unit, the user is burdened with the weight of the handle unit. In other words, extra burden from torque due to gravity applied to the handle unit is placed on the user in addition to an operating force to operate the handle unit.

Meanwhile, a vacuum cleaner employing a gravity compensation mechanism that uses elasticity of an elastic member to relieve the burden on the user by compensating the torque due to gravity is known. An example of this vacuum cleaner is disclosed in Korean Patent Publication No. 2001-0035934.

The vacuum cleaner disclosed in the publication includes a main cleaning body, a brush assembly rotationally combined with the main cleaning body, a shaft formed in the main cleaning body, and a torsion spring to support elasticity of the main cleaning body with one end fixed on the shaft and the other end fixed on the brush assembly, and compensates torque due to gravity applied to the main cleaning body with elastic force of the torsion spring.

However, with the gravity compensation mechanism disclosed in the publication, although the torque due to gravity applied to the main cleaning body may be compensated to some extent, it is difficult to compensate the torque as precisely as even the main cleaning body becomes in no weight state.

The reason is that since the magnitude of the torque due to gravity and the magnitude of the elastic torque of the torsion spring change independently according to an angle at which the main cleaning body is tilted, it is not easy or impossible to design a standard of the torsion spring to correspond the magnitude of the torque due to gravity with the magnitude of the elastic torque of the torsion spring at every angle.

DISCLOSURE

Technical Problem

The present disclosure provides a vacuum cleaner and gravity compensation apparatus therefor, to more precisely compensate torque due to gravity applied to a handle unit.

The present disclosure also provides a vacuum cleaner and gravity compensation apparatus therefor, to reduce operating force of the user by figuring out the user's intension and actively operating an handle.

Technical Solution

In accordance with one aspect of the present invention, a cleaner comprise a suction unit for cleaning a surface to be cleaned, a handle unit combined with the suction unit to be rotated around a rotation shaft, and a gravity compensation apparatus for applying compensation force to one side of the handle unit with respect to the rotation shaft to compensate torque due to gravity applied to the other side of the handle unit.

The gravity compensation apparatus may comprise an elastic member connected to the one side of the handle unit, and a sliding member for making translational movement in conjunction with turning motion of the handle unit to keep the compensation force in a constant direction regardless of an angle of the handle unit.

The direction of the compensation force may be kept in the gravity direction, regardless of the angle of the handle unit.

The cleaner may further comprise a moving pulley mounted in the sliding member to be moved with the sliding member.

The handle unit may comprise a first engagement pin and the sliding member may comprise a first engagement rail combined for the first engagement pin to be able to move in the vertical direction.

The sliding member may comprise a second engagement pin and the suction unit may comprise a second engagement rail combined for the second engagement pin to be able to move in the horizontal direction.

The elastic member may comprise a static load spring that generates a constant elastic power, regardless of a change in form of the elastic member.

The rotation shaft may protrude from the handle unit to be rotationally combined with the suction unit, and a point of application, to which the compensation force is applied, may be located a predetermined distance away from the rotation shaft.

The gravity compensation apparatus may further comprise a control means for adjusting magnitude of the compensation force.

The control means may comprise a control pulley connected to the elastic member, and a control motor for turning the control pulley.

The cleaner may further comprise a link member for connecting the handle unit and the elastic member, a control pulley connected to the link member, and a control motor for turning the control pulley.

The gravity compensation apparatus may further comprise a weight balancing means for shifting a center of gravity of the handle unit in order to adjust the magnitude of torque due to gravity applied to the handle unit.

The weight balancing means may comprise a balancing weight having a predetermined mass and movably arranged in the handle unit and an operating tool for moving the balancing weight in a length direction of the handle unit.

The operating tool may comprise a balancing motor for generating turning force and a balancing screw for converting the turning force of the balancing motor into straight-line motion of the balancing weight.

The gravity compensation apparatus may comprise a rotation displacement sensor for detecting rotation displacement of the handle unit or an operating force detection sensor for detecting operating force applied to the handle unit and a controller for controlling the magnitude of torque applied to the handle unit or compensation force of the gravity compensation apparatus, based on the results of the rotation displacement sensor or the operating force detection sensor.

The controller may be configured to if operating force or turning force is detected in the handle unit, control the magnitude of torque applied to the handle unit or compensation force of the gravity compensation apparatus in a way to decrease the operating force applied to the handle unit or the turning force of the handle unit.

The elastic member may be equipped in the sliding member to be moved with the sliding member.

In accordance with another aspect of the present invention, a cleaner comprise a suction unit for cleaning a surface to be cleaned, a handle unit combined with the suction unit to be rotated around a rotation shaft, an elastic member connected to a one side of the handle unit and generating compensation force to compensate torque due to gravity applied to the handle unit, and a compensation force direction holding member for keeping the compensation force by the elastic member against the handle unit in a constant direction.

The elastic member may comprise a static load spring that generates a constant elastic power, regardless of a change in form of the elastic member.

The compensation force direction holding member may comprise a sliding member for making translational movement in conjunction with turning motion of the handle unit to keep the compensation force in a constant direction regardless of an angle of the handle unit.

The cleaner may further comprise a moving pulley connected to the elastic member and mounted in the sliding member to be moved with the sliding member.

The elastic member may be equipped in the sliding member to be moved with the sliding member.

The cleaner may further comprise an adjusting means for adjusting the compensation force, wherein the adjusting means includes a control pulley connected to the elastic member, and a control motor for turning the control pulley.

The cleaner may further comprise a link member for connecting the handle unit and the elastic member and an adjusting means for adjusting the compensation force, and the adjusting means may comprise a control pulley connected to the link member, and a control motor for turning the control pulley.

The control motor may increase a magnitude of compensation force applied to the handle unit by turning in a normal/reverse direction.

The cleaner may further comprise a weight balancing means for shifting a center of gravity of the handle unit in order to adjust the magnitude of torque due to gravity applied to the handle unit.

The weight balancing means may comprise a balancing weight having a predetermined mass and movably arranged in the handle unit and an operating tool for moving the balancing weight in a length direction of the handle unit.

The cleaner may further comprise a rotation displacement sensor for detecting rotation displacement of the handle unit or an operating force detection sensor for detecting operating force applied to the handle unit; and a controller for controlling the magnitude of torque applied to the handle unit or compensation force of the gravity compensation apparatus, based on the results of the rotation displacement sensor or the operating force detection sensor.

The controller may be configured to if operating force or turning force is detected in the handle unit, control the magnitude of torque applied to the handle unit or compensation force of the gravity compensation apparatus in a way to decrease the operating force applied to the handle unit or the turning force of the handle unit.

In accordance with one aspect of the present invention, a gravity compensation apparatus for applying compensation force to one side of the handle unit with respect to the rotation shaft to compensate torque due to gravity applied to the other side of the handle unit, comprise an elastic member connected to the one side of the handle unit and a compensation force direction holding member for keeping the compensation force by the elastic member against the handle unit in a constant direction.

The elastic member may comprise a static load spring that generates a constant elastic power, regardless of a change in form of the elastic member.

The compensation force direction holding member may comprise a sliding member for making translational movement in conjunction with turning motion of the handle unit to keep the compensation force in a constant direction regardless of an angle of the handle unit.

The gravity compensation apparatus may further comprise a moving pulley connected to the elastic member and mounted in the sliding member to be moved with the sliding member.

The elastic member may be equipped in the sliding member to be moved with the sliding member.

The gravity compensation apparatus may further comprise an adjusting means for adjusting the compensation force, and the adjusting means may include a control pulley connected to the elastic member and a control motor for turning the control pulley.

The gravity compensation apparatus may further comprise a weight balancing means for shifting a center of gravity of the handle unit in order to adjust the magnitude of torque due to gravity applied to the handle unit.

The weight balancing means may comprise a balancing weight having a predetermined mass and movably arranged in the handle unit and an operating tool for moving the balancing weight in a length direction of the handle unit.

The gravity compensation apparatus may further comprise a rotation displacement sensor for detecting rotation displacement of the handle unit or an operating force detection sensor for detecting operating force applied to the handle unit and a controller for controlling the magnitude of torque applied to the handle unit or compensation force, based on the results of the rotation displacement sensor or the operating force detection sensor.

Advantageous Effects

According to an idea of the present disclosure, the torque due to gravity applied to a handle unit of a vacuum cleaner may be precisely compensated, thereby relieving the burden of the user from the weight of the handle unit while the user holds the handle unit for cleaning.

According to another idea of the present disclosure, it may be easy to design a standard of an elastic member to compensate torque due to gravity applied to the handle unit of the vacuum cleaner.

According to yet another idea of the present disclosure, the vacuum cleaner may be actively operated in a direction intended by the user by figuring out the user's intention, thereby reducing operating force of the user.

BEST MODE

Figure 1:
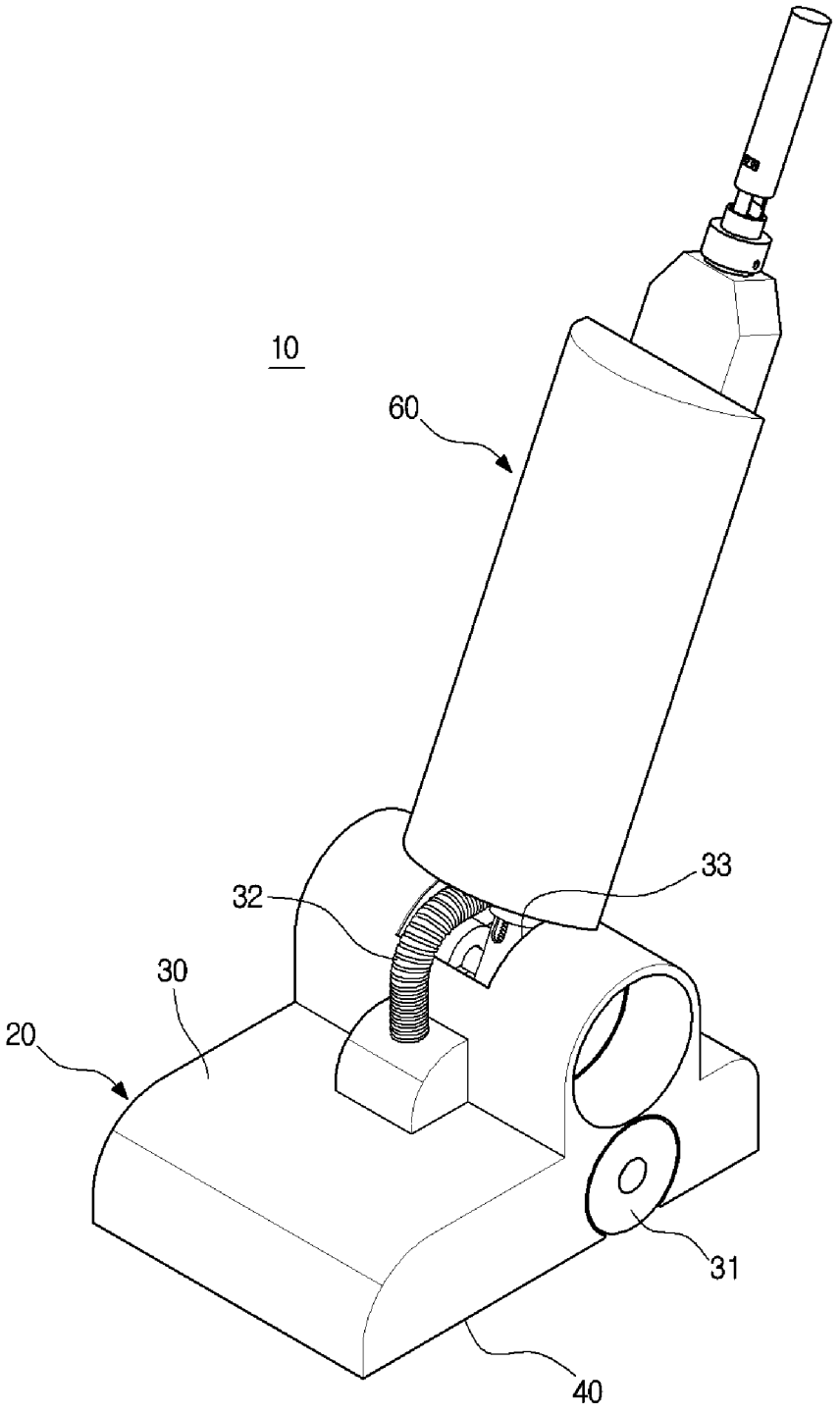
FIG. 1 is a perspective view illustrating the exterior of a vacuum cleaner, according to an embodiment of the present disclosure.

FIG. 1 is a perspective view illustrating the exterior of a vacuum cleaner, according to an embodiment of the present disclosure.

Figure 2:
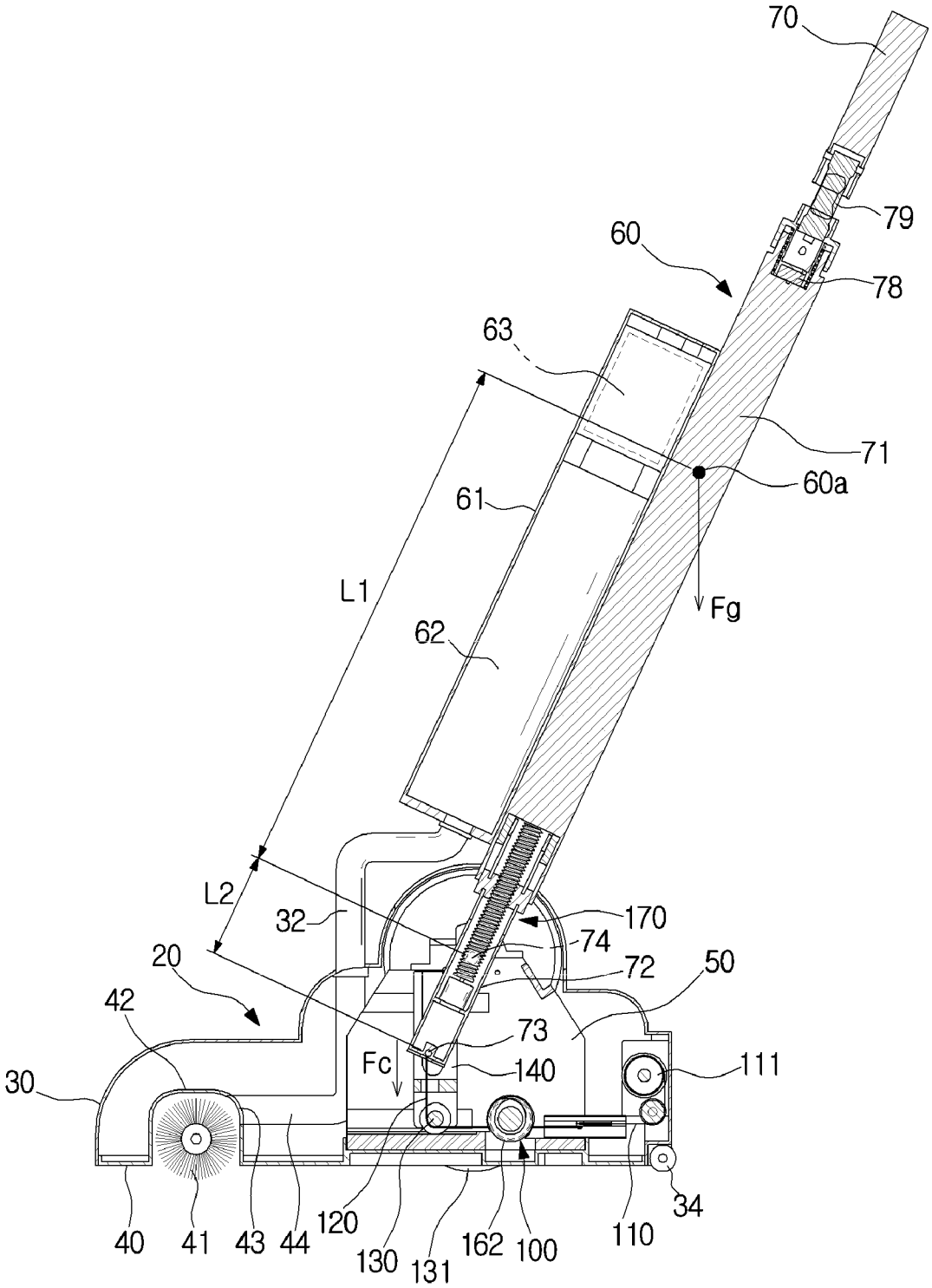
FIG. 2 is a cross-sectional view illustrating a side of a vacuum cleaner, according to an embodiment of the present disclosure.

FIG. 2 is a cross-sectional view illustrating a side of a vacuum cleaner, according to an embodiment of the present disclosure.

Referring to FIGS. 1 to 2, a vacuum cleaner and gravity compensation apparatus therefor in accordance with an embodiment of the present disclosure will be generally described.

A vacuum cleaner 10 includes a suction unit 20 for sucking in air of a surface to be cleaned, a handle unit 60 including a dust collector 62 for collecting dirt and a fan motor 63 for generating suction power, and rotationally combined with the suction unit 20, and a gravity compensation apparatus 100 for compensating torque due to gravity applied to the handle unit 60 when the handle unit 60 is tilted.

The air sucked in by the suction unit 20 may flow to the dust collector 62 of the handle unit 60 through a flexible hose 32. Dirt contained in the air sucked in may be collected in the dust collector 62, and the air out of which the dirt is collected may be released out of the handle unit 60 through an outlet (not shown).

The dust collector 62 may use a cyclone method to centrifugalize dirt from air, or a dust-bag method to separate dirt using a dust bag.

The suction unit 20 may include a top housing 30, a bottom plate 40 combined onto the bottom of the top housing 30, a brush 41 mounted in a brush mounter 42 of the bottom plate 40, an suction inlet 43 for sucking in air of a surface to be cleaned, a suction pipe 44 for guiding the air sucked in from the suction inlet 43 to the flexible hose 30, wheels 31 equipped on either side to be driven, and a caster 34 for preventing the suction unit 20 from falling backward.

The suction unit 20 may further include a support frame 50 to support elements of the handle unit 60 and gravity compensation apparatus 100. The support frame 50 may be installed in a support frame installer 46 of FIG. 4 of the bottom plate 40.

An opening 33 may be formed on the top face of the top housing 30, through which the handle unit 60 passes. That is, the handle unit 60 may pass through the opening 33 of the top housing 30 and be combined with the support frame 50 of the suction unit 20.

The handle unit 60 may include a dust collection unit 61 equipped with the dust collector 62 and a fan motor 63, a main stick 71, a grip 70 that may be held by the user, and a link stick 72 for combination with the suction unit 20.

The handle unit 60 may be equipped with at least one operating force detection sensors 78, 79 for detecting operating force of the user. In the embodiment, the handle unit 60 is equipped with a first operating force detection sensor 78 configured to detect an operating force in the length direction of the handle unit 60 and a second operating force detection sensor 79 configured to detect an operating force in the rotational direction of the handle unit 60.

The first operating force detection sensor 78 may be a pressure-type load cell, and the second operating force detection sensor 79 may be a bending-type load cell. What the user is going to do may be determined based on information collected through the first and second operating force detection sensors 78 and 79.

The gravity compensation apparatus 100 may include an elastic member 110 equipped in the suction unit 20 and having elasticity, a link member 120 for linking the handle unit 60 and the elastic member 110 and applying tension to the handle unit 60, a moving pulley 130 wound by the link member 120 and makes translational movement in conjunction with turning motion of the handle unit 60 to keep the direction of tension applied to the handle unit 60 constant in the gravity direction regardless of the angle θ (see FIGS. 5 and 6) of the handle unit 60, and a sliding member 140 to allow the moving pulley 130 to make translational movement in conjunction with the turning motion of the handle unit 60.

The link member 120 may include wires, belts, chains, etc., to generate tension and transfer elastic power of the elastic member 110 to the handle unit 60.

The gravity compensation apparatus 100 may also include a control motor 160 (see FIG. 4) and a control pulley 162 to apply rolling resistance to the handle unit 60 in order to reduce the influence of minor vibration or disturbance or further correct a possible error in compensation results. The control motor 160 and the control pulley 162 may be equipped in the link member 120.

Furthermore, the gravity compensation apparatus 100 may include a weight balancing means 170 for adjusting the magnitude of torque due to gravity applied to the handle unit 60 by shifting the center of gravity of the handle unit 60.

Features of the gravity compensation apparatus 100 in accordance with an embodiment of the present disclosure and effects thereof will now be described in detail.

Figure 3:
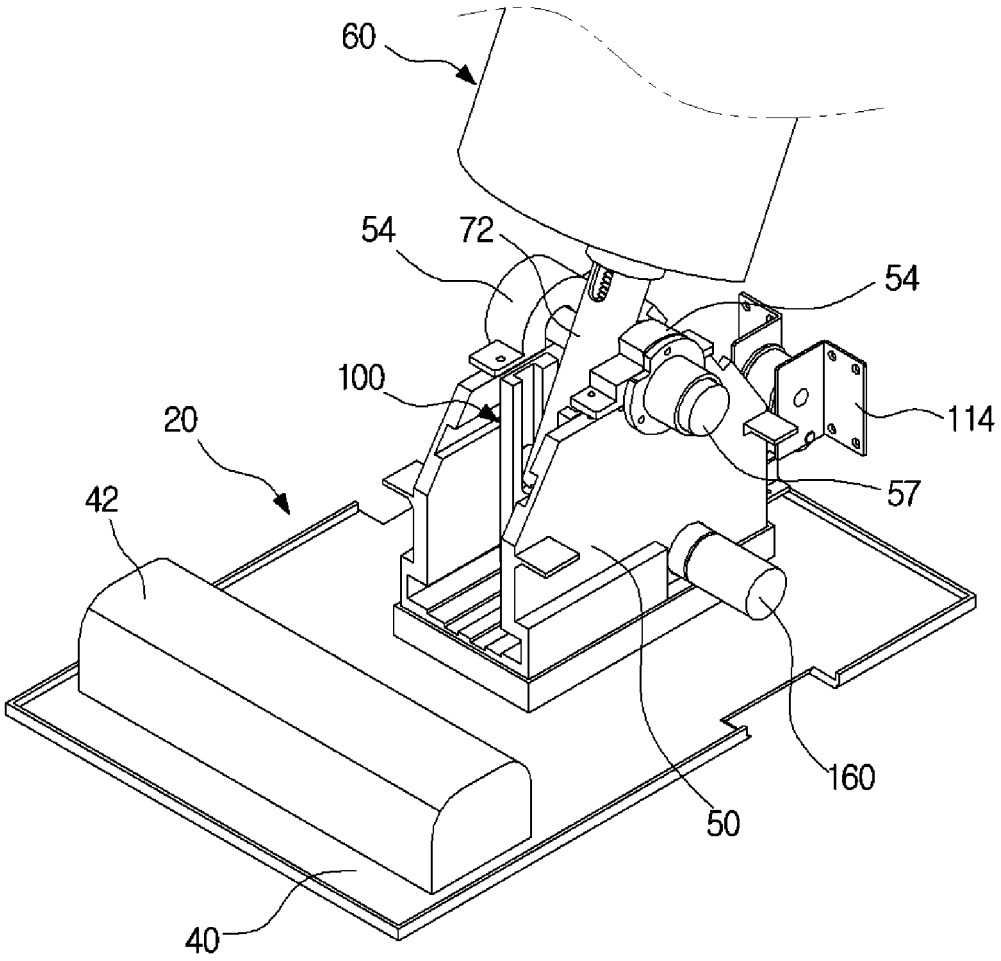
FIG. 3 is a view for explaining a combination relation between a suction unit and a handle unit of a vacuum cleaner with a top housing of the suction unit omitted, according to an embodiment of the present disclosure.
Figure 4:
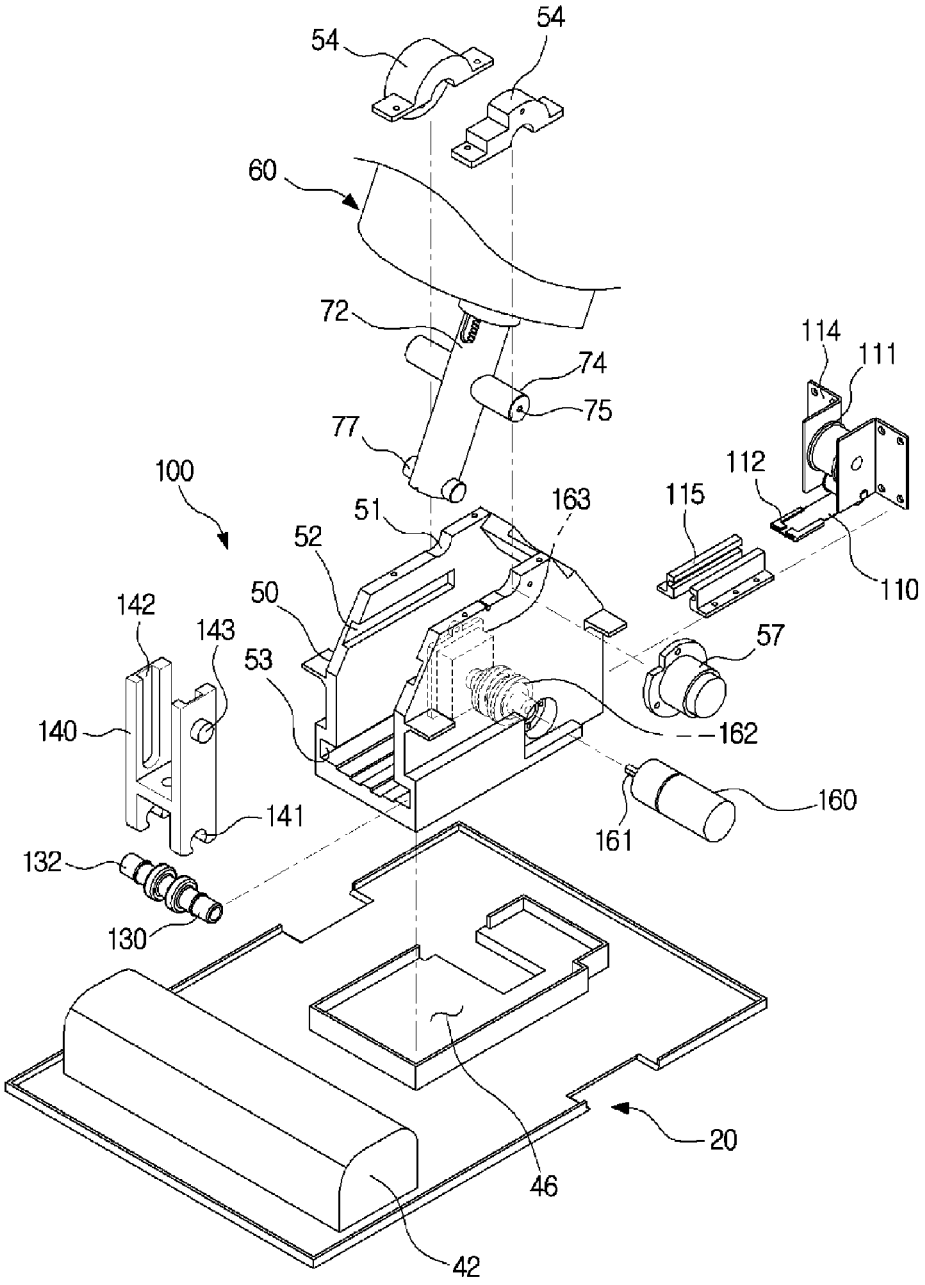
FIG. 4 is an exploded view for explaining features of a gravity compensation apparatus of a vacuum cleaner (with a link member omitted), according to an embodiment of the present disclosure.
Figure 5:
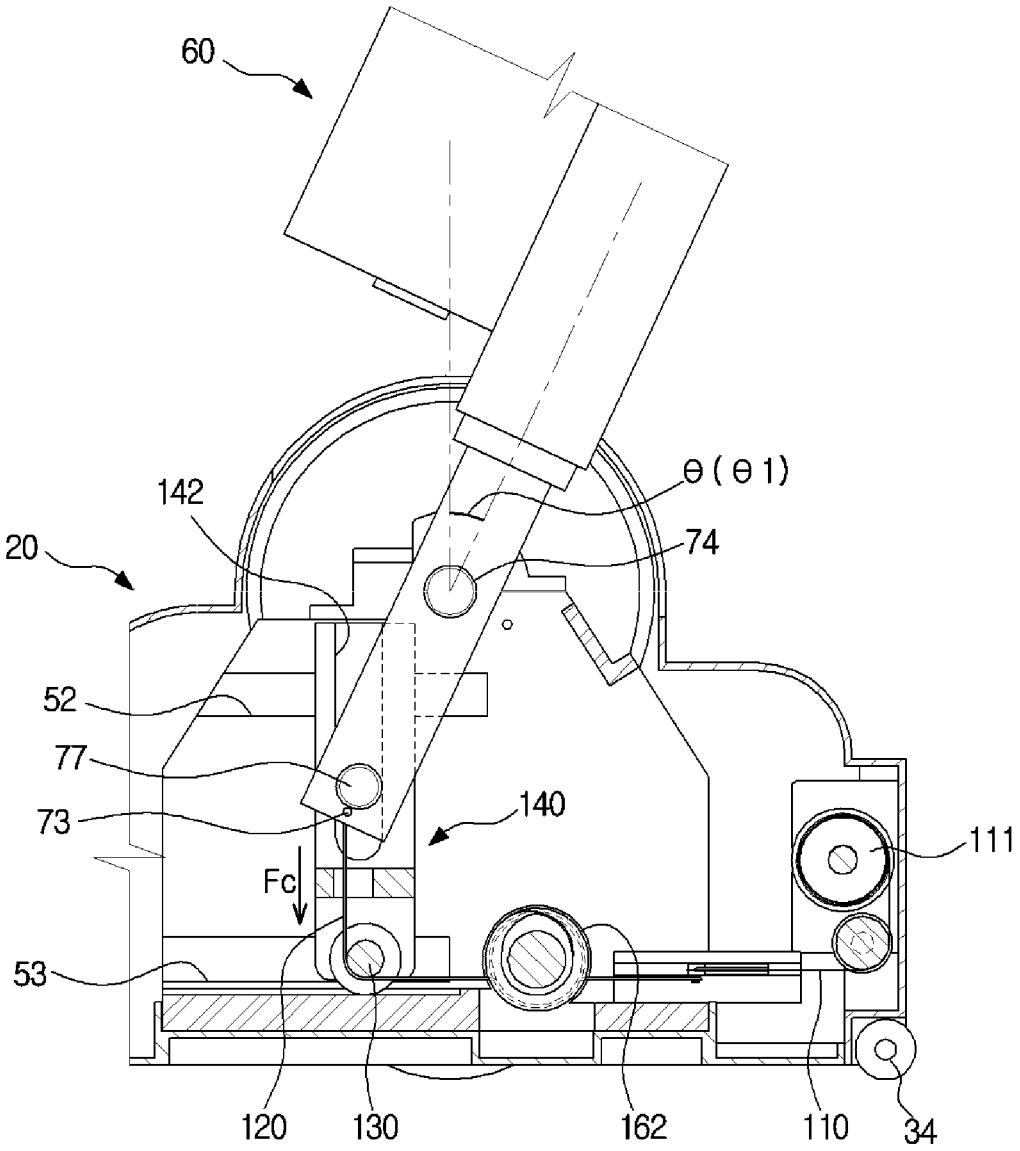
FIGS. 5 to 6 are views for explaining operation of a gravity compensation apparatus of a vacuum cleaner, according to an embodiment of the present disclosure.
Figure 6:
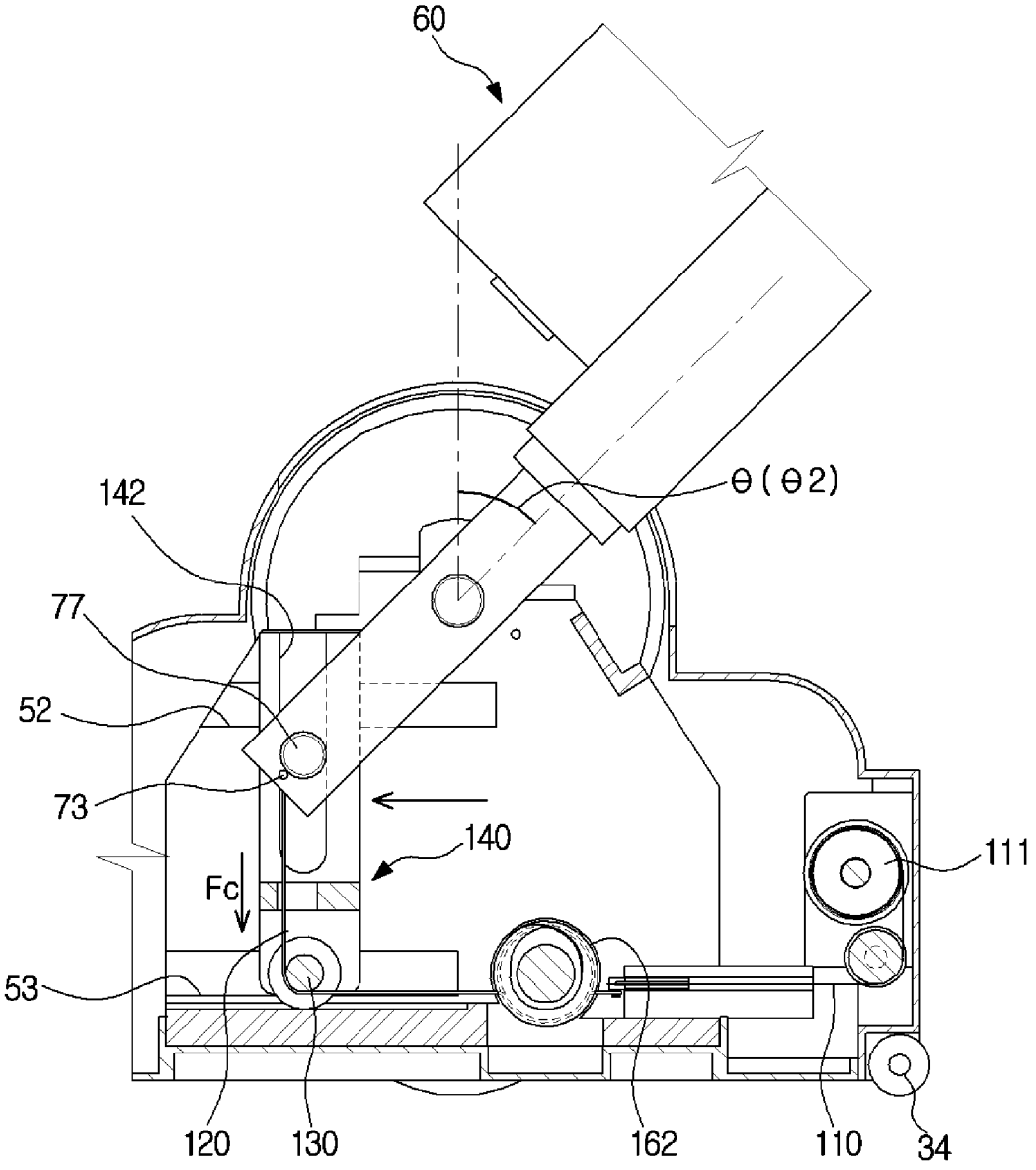

FIG. 3 is a view for explaining a combination relation between a suction unit and a handle unit of a vacuum cleaner with a top housing of the suction unit omitted, according to an embodiment of the present disclosure. FIG. 4 is an exploded view for explaining features of a gravity compensation apparatus of a vacuum cleaner (with a link member omitted), according to an embodiment of the present disclosure. FIGS. 5 to 6 are views for explaining operation of a gravity compensation apparatus of a vacuum cleaner, according to an embodiment of the present disclosure.

Referring to FIGS. 3 to 4, a combination relationship between the suction unit 20 and handle unit 60 of the vacuum cleaner in accordance with an embodiment of the present disclosure will be described.

The suction unit 20 and the handle unit 60 are rotationally combined with each other. For this, the link stick 72 of the handle unit 60 may have rotation shafts 74 protruding from either side, and rotation shaft containers 51 for containing the rotation shafts 74 and allowing them to be rotated may be formed on the top of the support frame 50 of the suction unit 20.

The rotation shafts 74 may be shaped like almost a cylinder, and the rotation shaft containers 51 may be shaped like almost a circular arc with the top open. The rotation shafts 74 may be placed down on the rotation shaft containers 51.

After the rotation shafts 74 are placed on the rotation shaft containers 51, they may be combined with holders 54 such that the holders 54 may cover the upper parts of the rotation shafts 74. The holders 54 may be securely combined with the support frame 50 through fastening members, such as screws.

With this structure, the suction unit 20 and the handle unit 60 may be rotationally combined with each other. However, since the rotation of the suction unit 20 is restricted while the suction unit 20 is supported against the surface to be cleaned, the handle unit 60 may turn around the suction unit 20.

If the handle unit 60 is in an upright position against the surface to be cleaned, the torque due to gravity may not work on the handle unit 60. On the other hand, if the handle unit 60 is tilted from the upright position, the torque due to gravity starts to be applied to the handle unit 60 and becomes a burden to the user who is holding the handle unit 60.

In an embodiment of the present disclosure, the gravity compensation apparatus 100 may compensate the torque due to gravity applied to the handle unit 20 not to place an extra burden to the user even if the handle unit 60 is tilted.

Especially, the gravity compensation apparatus 100 in accordance with an embodiment of the present disclosure may compensate the torque due to gravity more precisely, and has the merit of easily designing the gravity compensation apparatus 100, a standard of the elastic member 110 in particular, such as the modulus of elasticity.

In the meantime, in an embodiment of the present disclosure, a rotation displacement sensor 57 may be equipped in the vacuum cleaner to measure a rotation angle of the handle unit 60. For the rotation displacement sensor 57, a potentiometer using a variable resistor, or an encoder may be used.

A main sensor body of the rotation displacement sensor 57 may be combined with the support frame 50 or the holder 54, and a sensor rotation node (not shown) may be combined with a node combiner 75 of the rotation shaft 74 to be able to rotate with the rotation shaft 74.

As will be described later, information about operating force of the user collected by the operating force detection sensors 78, 79 and information about rotation of the handle unit 60 collected by the rotation displacement sensor 57 may be used in correcting an error in gravity compensation and in active operation control as intended by the user.

Referring to FIGS. 3 to 6, features of the gravity compensation apparatus 100 of a vacuum controller in accordance with an embodiment of the present disclosure will be described in detail.

The gravity compensation apparatus 100 includes an elastic member 110 having elasticity, a link member 120 for linking the elastic member 110 and the handle unit 60 and applying compensation force Fc to the handle unit 60, a moving pulley 130 wound by the link member 120 to change a direction of the compensation force Fc and making translational movement in conjunction with turning motion of the handle unit 60 such that the direction in which the compensation force Fc is applied to the handle unit 60 remains in the gravity direction regardless of the angle θ of the handle unit 60, and a sliding member 140 for translating the moving pulley 130 in conjunction with the turning motion of the handle unit 60.

It is assumed herein that the compensation force Fc is substantially tension of the link member 120, which is equal to elasticity of the elastic member 110.

No matter what form it has, any substance that has elasticity, such as coil spring, leaf spring, torsion spring, static load spring, etc., may be used for the elastic member 110. The static load spring refers to an elastic member formed to have a constant elasticity regardless of a change in the shape.

The static load spring may have an almost spirally winding form. The reason why the static load spring is desirable for the gravity compensation apparatus 100 in an embodiment of the present disclosure will be explained later.

The elastic member 110 may be formed to be wound by a reel 111, and the reel 111 may be mounted on a reel fixing plate 114 fixedly combined with the suction unit 20. A link member connector 112 to be combined with the link member 120 may be arranged on an end of the elastic member 110, and the elastic member 110 may be guided by a guide rail 115.

The link member 120 links the elastic member 110 and the handle unit 60. To compensate the torque due to gravity with less force according to the seesaw principle, a link point 73 of the link member 120 and the handle unit 60 is preferably located away from the rotation shaft 74 as far as possible. Although it has been described that the link member 120 links the elastic member 110 and the handle unit 60, it is possible to arrange the elastic member 110 to be directly connected to the moving pulley, and if it is possible to adjust the elasticity directly by the control pulley and control motor as will be described below, the elastic member 110 may be directly connected to the handle unit 60 with the link member omitted.

The link point 73 is also a point of application, on which the compensation force, i.e., the tension is applied to the handle unit 60. Furthermore, at the link point 73, the link member 120 should be connected to the handle unit 60 to be able to rotate against the handle unit 60.

The moving pulley 130 changes the direction of the link member 120 to the vertical direction, and consequently changes the direction of the compensation force Fc applied to the handle unit 60 to the gravity direction.

Further, the moving pulley 130 makes translational movement in conjunction with turning motion of the handle unit 60, thereby keeping the direction of the compensation force Fc applied to the handle unit 60 always in the gravity direction irregardless of the angle θ of the handle unit 60.

Specifically, assuming that the angle θ of the handle unit 60 shown in FIG. 5 is θ1 while the angle θ of the handle unit 60 shown in FIG. 6 is θ2, even if the angle θ of the handle unit 60 is changed from θ1 to θ2, the direction of the compensation force Fc applied to the handle unit 60 remains constant in the gravity direction.

As such, the reason of maintaining the direction of the compensation force Fc applied to the handle unit 60 to be in the gravity direction regardless of the angle θ of the handle unit 60 is to easily obtain a value of elasticity that makes the torque due to the compensation force Fc applied to the handle unit 60 equal in magnitude to the torque due to gravity applied to the handle unit 60, and further to compensate the torque due to gravity applied to the handle unit 60 more precisely.

To expatiate on this, assume that torque T1 due to gravity applied to the handle unit 60 is equal to the following equation:

$$T1=L1*Fg*\sin\theta \quad (1)$$

where L1 represents length from the rotation shaft 74 to the center of gravity 60*a* of the handle unit, and Fg represents magnitude of the gravity (see FIG. 2).

If the direction of the compensation force Fc applied to the handle unit 60 remains constant in the direction of gravity regardless of the angle θ of the handle unit 60, torque T2 due to the compensation force Fc applied to the handle unit 60 may be summarized as follows:

$$T2=L2*Fc*\sin\theta=L2*Fe*\sin\theta \quad (2)$$

where L2 represents length from the rotation shaft 74 to the link point 73 of the link member, and Fe represents magnitude of the elasticity of the elastic member 110 (see FIG. 2).

The elasticity Fe to compensate the torque T1 due to gravity applied to the handle unit 60 may be easily obtained in equation of T1=T2 as follows:

$$Fe=L1*Fg/L2 \quad (3)$$

As a result, since the magnitude of gravity Fg applied to the handle unit 60 is constant, and a ratio of L1/L2 is also constant, it is desirable to keep the elasticity of the elastic member 110 constant regardless of a change in the form, and thus, it should be noted that it is desirable that the elastic member 110 is static load spring.

Meanwhile, the gravity compensation apparatus 100 in accordance with an embodiment of the present disclosure may include the sliding member 140 for translating the moving pulley 130 in conjunction with turning motion of the handle unit 60 such that the direction of the compensation force Fc applied to the handle unit 60 remains constant regardless of the angle θ of the handle unit 60.

The sliding member 140 is formed to be translated in conjunction with the turning motion of the handle unit 60. The moving pulley 130 may be equipped in the sliding member 140 to be moved together. For this, a pulley mounting groove 141 for receiving a pulley shaft 132 of the moving pulley 130 may be formed in the sliding member 140.

Furthermore, a pair of first engagement pins 77 may be arranged on either side of the handle unit 60, and a pair of first engagement rails 142 to be combined with the first engagement pins 77 to be able to move vertically may be arranged in the sliding member 140.

Moreover, a pair of second engagement pins 143 may be arranged on either side of the handle unit 140, and a pair of second engagement rails 52 to be combined with the second engagement pins 143 to be able to move horizontally may be arranged in the support frame 50 of the suction unit 20.

In addition, a pair of third engagement rails 53 combined for the pulley shaft 132 of the moving pulley 130 to be movable in the horizontal direction may be arranged in the support frame 50 of the suction unit 20.

With the structure, when the handle unit 60 turns clockwise with respect to FIGS. 5 and 6, the sliding member 140 and the moving pulley 130 may make translational movements to the left. On the other hand, if the handle unit 60 turns counterclockwise, the sliding member 140 and the moving pulley 130 may make translational movements to the right.

With these features, the gravity compensation apparatus 100 in accordance with an embodiment of the present disclosure may have buffering effects on disturbance and vibration, as the rolling resistance of the handle unit 60 basically increases by friction between the moving pulley 130 and the sliding member 140.

The gravity compensation apparatus 100 in accordance with an embodiment of the present disclosure may include the control motor 160 and control pulley 162 to apply rolling resistance, i.e., a kind of friction to the handle unit 60 in order to reduce the influence of minor vibration or disturbance or further correct a possible error in compensation results, by adjusting the magnitude of tension Fc applied to the handle unit 60.

The rotation shaft 161 of the control motor 160 is combined with the control pulley 162 to rotate the control pulley 162, and the control pulley 162 is wound by the link member 120. The control pulley 162 may be rotationally supported by a control pulley support member 163 combined with the support frame 50.

While no current is applied to the control motor 160, the control motor 160 may apply rolling resistance to the handle unit 60. Specifically, since the control motor 160 has detent torque to resist against rotation while no current is applied, if torque applied to the rotation shaft 161 of the control motor 160 is not greater than the detent torque, the handle unit 60 might not turn.

In other words, the handle unit 60 may be said to have static friction as much as the detect torque of the control motor 160. The detent torque of the control motor 160 may be applied in both directions. Furthermore, since it is applied even when the user is operating the handle unit 60 in person with an operating force, the user may turn the rotation member 160 by applying an operating force greater than the rolling resistance of the control motor 160.

In this regard, the control motor 160 may serve as a resistor device to generate a certain magnitude of rolling resistance. Unlike the embodiment of the present disclosure, an apparatus to generate other resistance, e.g., a damping apparatus, may be used as the resistance device, in addition to the control motor 160.

Meanwhile, if there is an error in the gravity compensation result, the control motor 160 may serve to correct the error. In other words, if the torque due to the compensation force Fc applied to the handle unit 60 is less than the torque due to gravity, the control motor 160 may increase the compensation force Fc by pulling on the link member 120 by turning the control pulley 162 in one direction.

On the contrary, if the torque due to the compensation force Fc applied to the handle unit 60 is greater than the torque due to gravity, the control motor 160 may decrease the compensation force Fc by loosening the link member 120 by turning the control pulley 162 in the other direction.

In this regard, the control motor 6 may be said to serve as an actuator that increases/decreases the compensation force Fc. Although in the embodiment, a structure in which the control pulley 162 is connected to the link member 120 for increasing/decreasing compensation force has been described, the control pulley 162 may be directly connected to the elastic member 110 for increasing/decreasing compensation force. Furthermore, the control pulley 162 is arranged to be automatically rotated by the control motor 160 in the embodiment, but unlike this, it is also possible for the user to turn the control pulley 162 in person to increase/decrease the compensation force.

Functions of the control motor 160 as a rolling resistor and as an actuator for correcting an error in gravity compensation results have thus far been examined, the control motor 160 may further serve to actively turn the handle unit 60 to decrease operating force of the user after figuring out the user's intention. This will be further described in the following.

Figure 7:
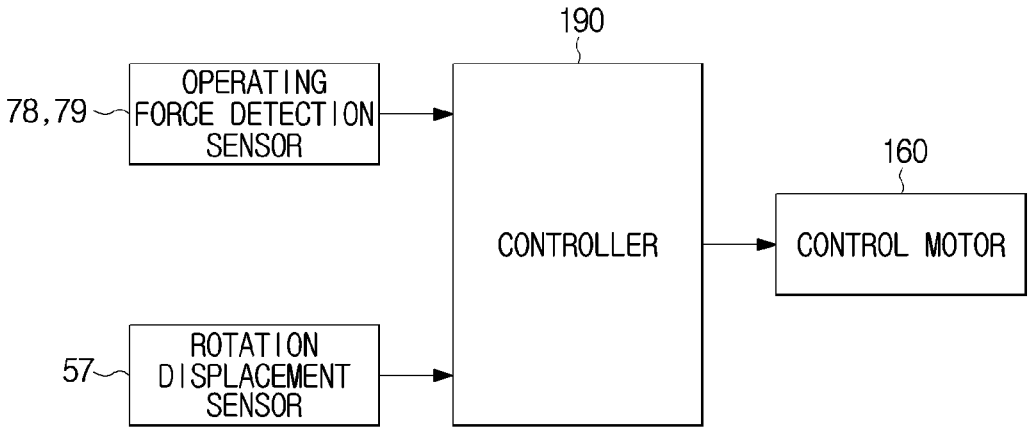
FIG. 7 is a control block diagram of a control motor of a vacuum cleaner, according to an embodiment of the present disclosure.
Figure 8:
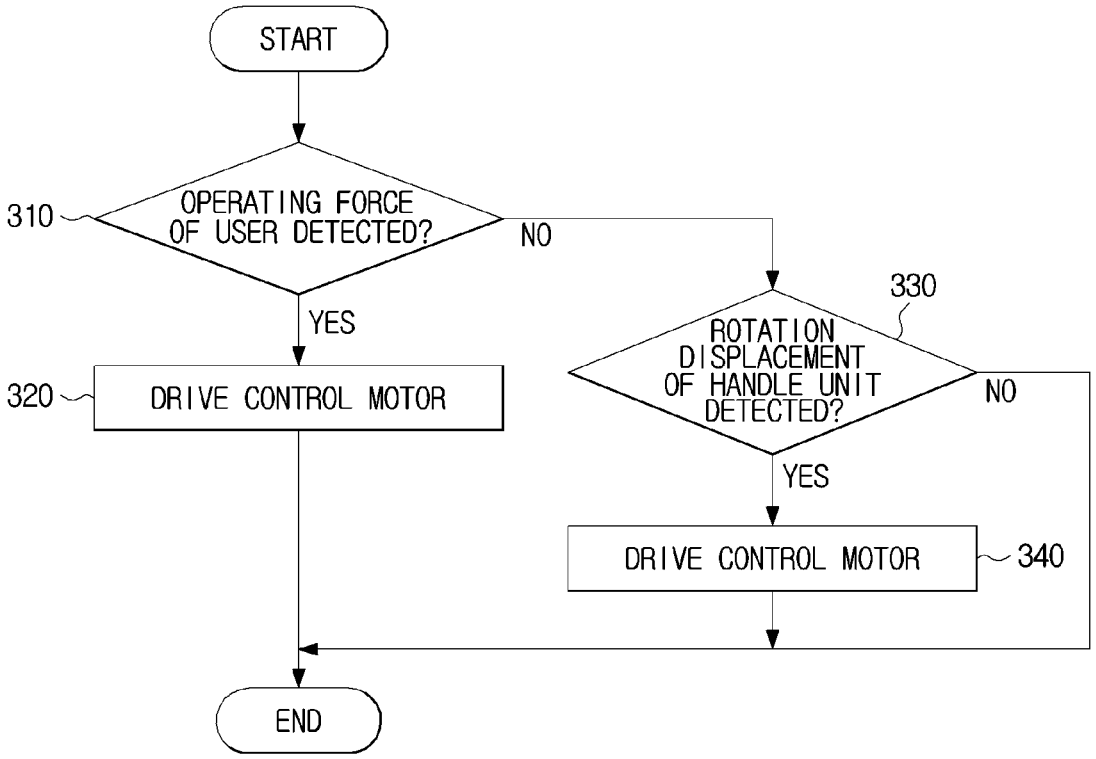
FIG. 8 is a control flowchart of a control motor of a vacuum cleaner, according to an embodiment of the present disclosure.

FIG. 7 is a control block diagram of a control motor of a vacuum cleaner, according to an embodiment of the present disclosure. FIG. 8 is a control flowchart of a control motor of a vacuum cleaner, according to an embodiment of the present disclosure.

Referring to FIGS. 7 to 8, a method for controlling the control motor 160 in the gravity compensation apparatus in accordance with an embodiment of the present disclosure will be described.

A vacuum cleaner may include a controller 190 for receiving information about an operating force applied by the user to the handle unit 60 from the operating force sensors 78, 79, receiving information about turning motion of the handle unit 60 from the rotation displacement sensor 57, and driving the control motor 160 based on the information.

The controller 190 may drive the control motor 160 by increasing or decreasing the compensation force applied to the handle unit 60 when an operating force of the user is applied to the handle unit 60 to turn the handle unit 60 to the direction in which the operating force is applied. This may reduce the operating force of the user.

The method for controlling the control motor 160 will be summarized as in the flowchart of FIG. 8.

First, it is detected from the operating force detection sensors 78, 79 whether operating force is applied by the user to the handle unit 60, in 310.

If operating force is applied by the user, the controller 190 may drive the control motor 160 in the normal direction or in the reverse direction such that the handle unit 60 turns in the direction of the operating force, in 320.

If operating force is not applied by the user, it is detected from the rotation displacement sensor 57 whether rotation displacement has occurred in the handle unit 60, in 330.

If the rotation displacement has occurred in the handle unit 60, it means that an error in the gravity compensation result has occurred, and thus the controller 190 may drive the control motor 160 in the normal direction or reverse direction to correct the error, in 340.

Figure 9:
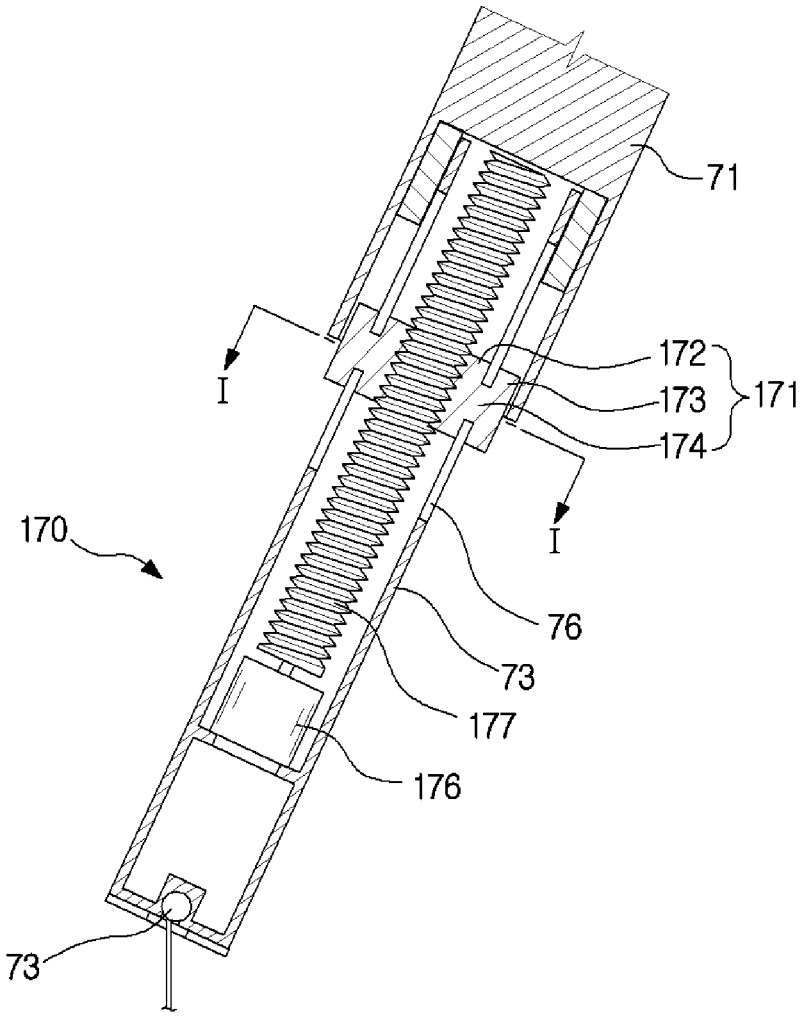
FIG. 9 is an enlarged cross-sectional view of a balancing means of a vacuum cleaner, according to an embodiment of the present disclosure.
Figure 10:
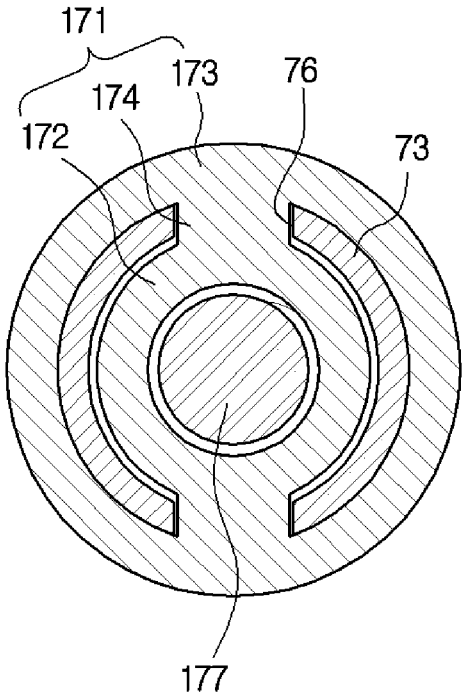
FIG. 10 is a cross-sectional view for explaining a balancing means of a vacuum cleaner, which is cut along line I-I of FIG. 9, according to an embodiment of the present disclosure.
Figure 11:
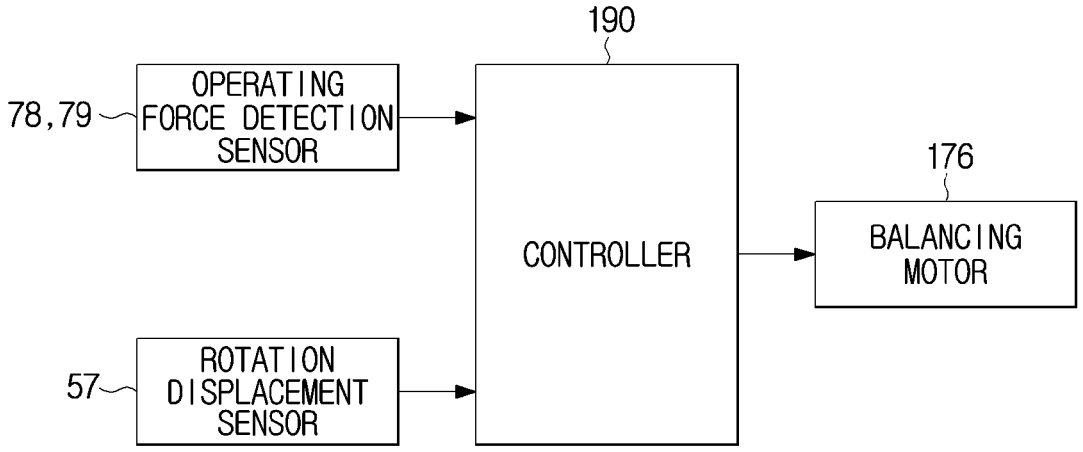
FIG. 11 is a control block diagram of a balancing motor of a vacuum cleaner, according to an embodiment of the present disclosure.
Figure 12:
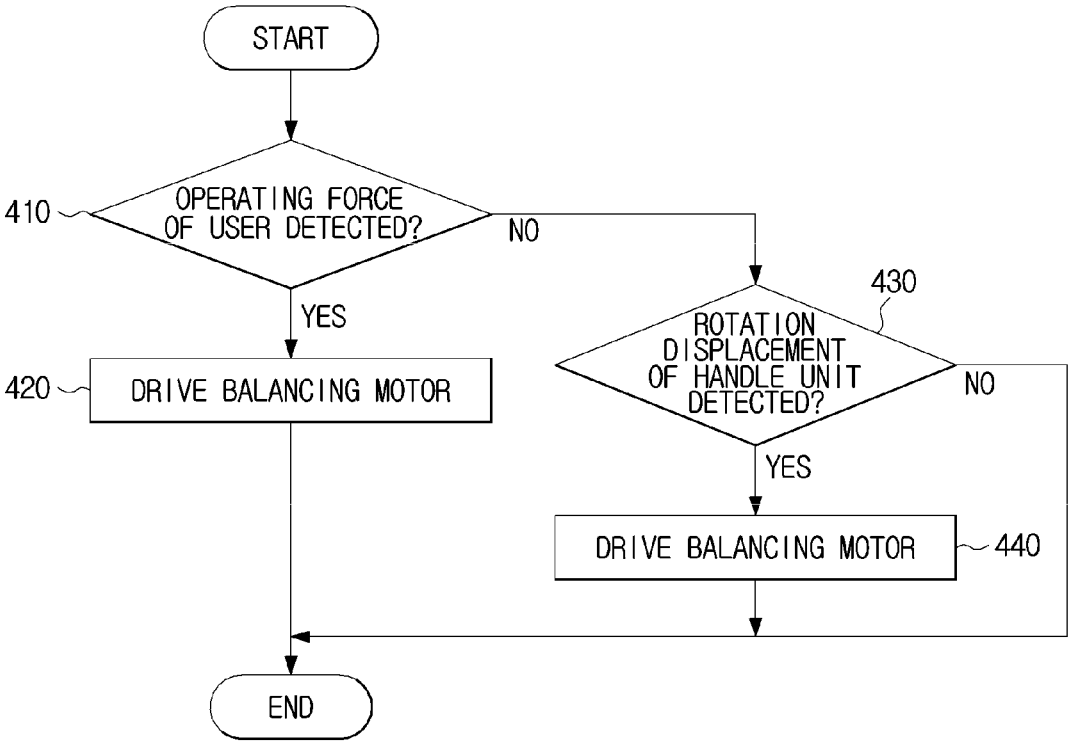
FIG. 12 is a control flowchart of a balancing motor of a vacuum cleaner, according to an embodiment of the present disclosure.

FIG. 9 is an enlarged cross-sectional view of a balancing means of a vacuum cleaner, according to an embodiment of the present disclosure. FIG. 10 is a cross-sectional view for explaining a balancing means of a vacuum cleaner, which is cut along line I-I of FIG. 9, according to an embodiment of the present disclosure. FIG. 11 is a control block diagram of a balancing motor of a vacuum cleaner, according to an embodiment of the present disclosure. FIG. 12 is a control flowchart of a balancing motor of a vacuum cleaner, according to an embodiment of the present disclosure.

Referring to FIGS. 9 to 12, a weight balancing means 170 of a gravity compensation apparatus in accordance with an embodiment of the present disclosure will be described.

The gravity compensation apparatus 100 may include the weight balancing means 170 for adjusting the magnitude of torque due to gravity applied to the handle unit 60 by shifting the center of gravity of the handle unit 60.

The weight balancing means 170 may include a balancing weight 171 having a certain mass and arranged to be movable by the handle unit 60, a balancing motor 176 for generating turning force, and a balancing screw 177 for converting the turning force of the balancing motor 176 to a straight-line motion of the balancing weight 171.

The balancing weight 171 may be movably supported against the connection stick 72 of the handle unit 60. The balancing weight 171 may be comprised of an internal weight 172 placed in the internal space of the connection stick 72, an external weight 173 placed outside of the connection stick 72, and a connector 174 placed in an opening 76 of the connection stick 72 for connecting the internal weight 172 and the external weight 173.

A screw thread is formed in the internal weight 172 to correspond to a screw thread of the balancing screw 177, and when the balancing screw 177 is turned, the balancing weight 171 may be moved away from or close to the rotation shaft 74 of the handle unit 60 along the connection stick 72.

Accordingly, since the handle unit 60 is changed in its center of gravity as the balancing weight 171 moves, and there is an effect that the point of application of gravity applied to the handle unit 60 gets far or close, torque due to gravity applied to the handle unit 60 may be adjusted.

In other words, while the weight balancing means aims at error correction of gravity compensation and active rotation of the handle unit 60 as the control motor 160 does, there is a methological difference between them in that the weight balancing means adjusts the center of gravity of the handle unit 60 while the control motor 160 adjusts the compensation force Fc applied to the handle unit 60.

A vacuum cleaner may include a controller 190 for receiving information about operating force applied by the user to the handle unit 60 from the operating force sensors 78, 79, receiving information about turning motion of the handle unit 60 from the rotation displacement sensor 57, and driving the balancing motor 176 based on the information.

A method for controlling the balancing motor 160 will be described with the flowchart of FIG. 12.

First, it is detected from the operating force detection sensors 78, 79 whether operating force is applied by the user to the handle unit 60, in 410.

If operating force is applied by the user, the controller 190 may shift the center of gravity of the handle unit 60 by driving the balancing motor 176 to turn the handle unit 60 in the direction of the operating force, in 420.

If operating force is not applied by the user, it is detected from the rotation displacement sensor 57 whether rotation displacement has occurred in the handle unit 60, in 430.

If the rotation displacement has occurred in the handle unit 60, it means that an error in the gravity compensation result has occurred, and thus the controller 190 may drive the balancing motor 176 in the normal direction or reverse direction to correct the error, in 440.

The weight balancing means is not limited thereto, but may also be arranged to have a balancing weight, and hydraulic cylinder or a solenoid device connected to the balancing weight for shifting the balancing weight through expansion/contraction of the hydraulic cylinder or solenoid device. That is, although in the embodiment the balancing motor 176 and the balancing screw 177 are used as operating tools for operating the balancing weight, the hydraulic cylinder or solenoid device may be used instead.

Furthermore, although in the embodiment an occasion when the balancing weight 171 is automatically adjusted by the balancing motor 176 is described, the user may manually adjust the balancing weight in person without the balancing motor.

As such, the gravity compensation apparatus of the vacuum cleaner in accordance with an embodiment of the present disclosure may perform more precise gravity compensation with a structure to primarily keep the direction of the compensation force Fc applied to the handle unit 60 constant in the gravity direction, and perform additional compensation with the control motor 160 and the weight balancing means 170 even if there is an error in the gravity compensation result.

Moreover, the handle unit 60 actively rotated by figuring out the user's intention may reduce the operating force of the user.

In the aforementioned embodiments, the error in gravity compensation results of the handle unit 60 is corrected through the operating force detection sensors 78, 79 and/or rotation displacement sensor 57 of the handle unit 60, or the operating force of the handle unit 60 is actively improved according to the user's intention, but such correction of error in gravity compensation results or improvement in the operating force on the handle unit 60 may also be attempted even by other detector means.

For example, if dirt builds up in the dust collector 62 installed in the handle unit 60, the weight of the handle unit 60 increases accordingly. Therefore, once the weight of the dust collector 62 installed in the handle unit 60 is detected and a change of the weight is detected, it is also possible to change the content of gravity compensation through the control motor 160 or the weight balancing means 170 to correspond to the changed weight.

Figure 13:
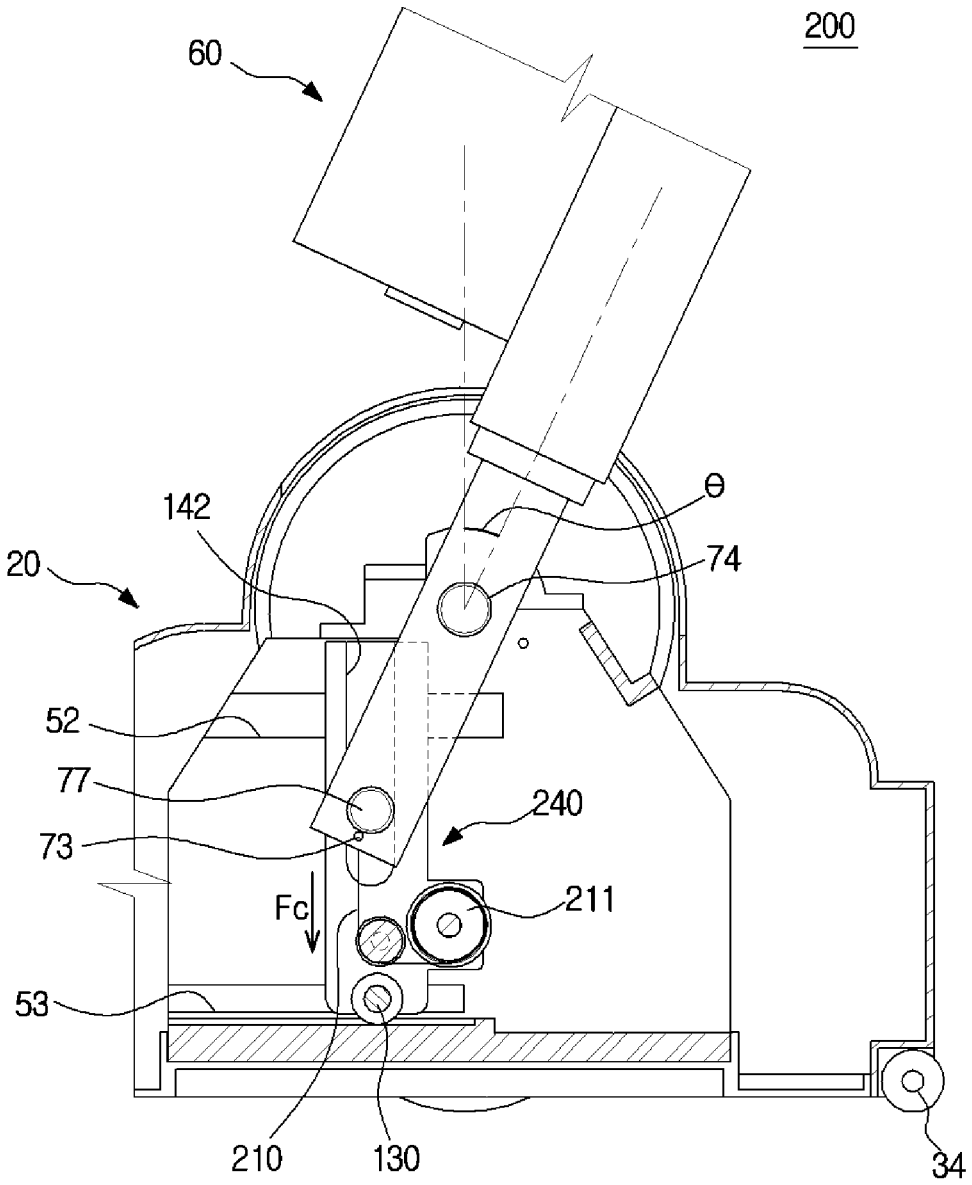
FIG. 13 is a view for explaining features of a vacuum cleaner, according to another embodiment of the present disclosure.

FIG. 13 is a view for explaining features of a vacuum cleaner, according to another embodiment of the present disclosure.

Referring to FIG. 13, the features of a vacuum cleaner in accordance with another embodiment of the present disclosure is described. The same features as in the aforementioned embodiment are denoted by the same reference numerals, and the overlapping description will be omitted herein.

A gravity compensation apparatus of a vacuum cleaner 200 in accordance with another embodiment of the present disclosure may include an elastic member 210 having elasticity to generate a compensation force, and a sliding member 240, on which the elastic member 210 is mounted, for making translational movement in conjunction with turning motion of the handle unit 60 to keep the compensation force in a constant direction regardless of the angle θ of the handle unit 60.

Accordingly, the elastic member 210 may be moved with the sliding member 240.

As in the aforementioned embodiment of the present disclosure, the elastic member 210 is preferably a static load spring, and a reel 211 wound by the elastic member 210 may be fixed on the sliding member 240.

A structure in which the sliding member 240 makes translational movement in conjunction with turning motion of the handle unit 60 is the same as what is described above in the aforementioned embodiment.

With the structure, the compensation force Fc applied to the handle unit 60 may be more simply kept constant regardless of the angle of the handle unit 60.

While the disclosure has been shown and described with reference to certain exemplary embodiments thereof, it will be understood by those skilled in the art that various changes in form and details may be made therein without departing from the spirit and scope of the invention as defined by the appended claims and their equivalents.

The invention claimed is:

1. A cleaner comprising:

a suction unit for cleaning a surface to be cleaned;

a handle unit combined with the suction unit to be rotated around a rotation shaft; and a gravity compensator for applying compensation force to one side of the handle unit with respect to the rotation shaft to compensate torque due to gravity applied to the other side of the handle unit, wherein the gravity compensator comprises a slider for making a translational movement in conjunction with a turning motion of the handle unit to maintain the compensation force in a constant direction regardless of an angle of the handle unit.

2. The cleaner of claim 1, wherein the gravity compensator further comprises an elastic connected to the one side of the handle unit.

3. The cleaner of claim 2, wherein the direction of the compensation force is kept in the gravity direction, regardless of the angle of the handle unit.

4. The cleaner of claim 2, further comprising: a moving pulley mounted in the slider to be moved with the slider.

5. The cleaner of claim 2, wherein the handle unit comprises a first engagement pin, and wherein the slider comprises a first engagement rail combined for the first engagement pin to be able to move in the vertical direction.

6. The cleaner of claim 5, wherein the slider comprises a second engagement pin, and wherein the suction unit comprises a second engagement rail combined for the second engagement pin to be able to move in the horizontal direction.

7. The cleaner of claim 2, wherein the elastic comprises a static load spring that generates a constant elastic power, regardless of a change in form of the elastic.

8. The cleaner of claim 2, wherein the gravity compensator further comprises a controller for adjusting magnitude of the compensation force.

9. The cleaner of claim 8, wherein the controller comprises a control pulley connected to the elastic, and a control motor for turning the control pulley.

10. The cleaner of claim 8, further comprising: a connector for connecting the handle unit and the elastic, wherein the controller comprises a control pulley connected to the connector, and a control motor for turning the control pulley.

11. The cleaner of claim 2, wherein the elastic is equipped in the slider to be moved with the slider.

12. The cleaner of claim 1, wherein the rotation shaft protrudes from the handle unit to be rotationally combined with the suction unit, and a point of application, to which the compensation force is applied, is located a predetermined distance away from the rotation shaft.

13. The cleaner of claim 1, wherein the gravity compensator further comprises a weight balancer for shifting a center of gravity of the handle unit in order to adjust the magnitude of torque due to gravity applied to the handle unit.

14. The cleaner of claim 13, wherein the weight balancer comprises a balancing weight having a predetermined mass and movably arranged in the handle unit; and a balancer for moving the balancing weight in a length direction of the handle unit.

15. The cleaner of claim 14, wherein the balancer comprises a balancing motor for generating turning force; and a balancing screw for converting the turning force of the balancing motor into straight-line motion of the balancing weight.

16. The cleaner of claim 1, wherein the gravity compensator comprises a rotation displacement sensor for detecting rotation displacement of the handle unit or an operating force detection sensor for detecting operating force applied to the handle unit; and a controller for controlling the magnitude of torque applied to the handle unit or compensation force of the gravity compensator, based on the results of the rotation displacement sensor or the operating force detection sensor.

17. The cleaner of claim 16, wherein the controller is configured to if operating force or turning force is detected in the handle unit, control the magnitude of torque applied to the handle unit or compensation force of the gravity compensator in a way to decrease the operating force applied to the handle unit or the turning force of the handle unit.

18. A gravity compensator for applying compensation force to one side of a handle unit with respect to the rotation shaft to compensate torque due to gravity applied to the other side of the handle unit, the gravity compensator comprising:

an elastic connected to the one side of the handle unit; and a compensator for maintaining the compensation force by the elastic against the handle unit in a constant direction, wherein the compensator comprises a slider for making a translational movement in conjunction with a turning motion of the handle unit to keep the compensation force in a constant direction regardless of an angle of the handle unit.

19. A gravity compensator for applying compensation force to one side of a handle unit with respect to the rotation shaft to compensate torque due to gravity applied to the other side of the handle unit, the gravity compensator comprising:

an elastic connected to the one side of the handle unit;

a compensator for maintaining the compensation force by the elastic against the handle unit in a constant direction;

a rotation displacement sensor for detecting rotation displacement of the handle unit or an operating force detection sensor for detecting operating force applied to the handle unit; and a controller for controlling the magnitude of torque applied to the handle unit or compensation force, based on the results of the rotation displacement sensor or the operating force detection sensor.

20. A cleaner comprising:

a suction unit for cleaning a surface to be cleaned;

a handle unit combined with the suction unit to be rotated around a rotation shaft;

an elastic member connected to a one side of the handle unit and generating compensation force to compensate torque due to gravity applied to the handle unit; and a compensation force direction holding member for keeping the compensation force by the elastic member against the handle unit in a constant direction, wherein the elastic member comprises a static load spring that generates a constant elastic power, regardless of a change in form of the elastic member.

* * * * *